US009038870B2

(12) United States Patent
Johnson

(10) Patent No.: US 9,038,870 B2
(45) Date of Patent: May 26, 2015

(54) HEAD MOUNT APPARATUS FOR HANDS-FREE VIDEO RECORDING WITH AN ELECTRONIC DEVICE

(71) Applicant: August A. Johnson, Boise, ID (US)

(72) Inventor: August A. Johnson, Boise, ID (US)

( * ) Notice: Subject to any disclaimer, the term of this patent is extended or adjusted under 35 U.S.C. 154(b) by 65 days.

(21) Appl. No.: 13/895,289

(22) Filed: May 15, 2013

(65) Prior Publication Data

US 2013/0306689 A1 Nov. 21, 2013

Related U.S. Application Data

(60) Provisional application No. 61/647,412, filed on May 15, 2012, provisional application No. 61/656,356, filed on Jun. 6, 2012.

(51) Int. Cl.
*A45C 11/00* (2006.01)
*A45F 5/00* (2006.01)

(52) U.S. Cl.
CPC . *A45C 11/00* (2013.01); *A45F 5/00* (2013.01); *A45F 2200/0516* (2013.01); *A45F 2200/0533* (2013.01)

(58) Field of Classification Search
CPC ..... A42B 1/24–1/248; A45F 2200/0516; A45F 2200/0533; A45F 5/00
USPC ..... 224/181, 250, 929, 930
See application file for complete search history.

(56) References Cited

U.S. PATENT DOCUMENTS 439,786 A 11/1890 Low
1,315,326 A 9/1919 Palis
1,739,801 A 12/1929 Pitts
1,885,103 A 11/1932 Barnett
2,139,849 A 12/1938 Powers
2,286,389 A 6/1942 Sowin
2,302,300 A 11/1942 Davies
2,315,387 A 3/1943 Bambenek et al.
2,461,897 A * 2/1949 Hopkins ..... 224/331
2,502,714 A 4/1950 Garnett (Continued)

OTHER PUBLICATIONS

Various products shown on KICKSTARTER™ website, https://www.kickstarter.com/projects/ . . . , printed prior to Jan. 2012.

(Continued)

*Primary Examiner* — Adam Waggenspack
(74) *Attorney, Agent, or Firm* — Pedersen and Company, PLLC; Ken J. Pedersen; Barbara S. Pedersen

(57) ABSTRACT

A head mount device is worn by a person to retain an electronic device in a desirable position for hand-free use as a video recorder. A head strap assembly with tri-glide adjustment mechanisms extends from the sides and top of the main body mounting plate, allowing the device to fit most head sizes. The mounting plate is preferably an injection-molded part for holding the electronic device in a horizontal position with an elastic retention strap securing mechanism between the mounting plate and the electronic device. An elastic strap extends from an upending portion of the mounting plate, wraps around the electronic device, extends through a slot in the mounting plate, and fastens back upon itself via hook and loop fasteners to capture the device in landscape orientation. The design of the mounting plate and preferred length of the retention strap fit most modern smartphone designs by simply tightening the retention strap around the smartphone.

14 Claims, 10 Drawing Sheets

(56) References Cited

U.S. PATENT DOCUMENTS

| | | | | |
|---|---|---|---|---|
| 2,605,891 | A | 8/1952 | Jones | |
| 2,908,522 | A | 10/1959 | Glave | |
| 3,011,649 | A | 12/1961 | Porter | |
| D203,101 | S | 12/1965 | Holder | |
| 3,224,720 | A | 12/1965 | Hain | |
| 3,966,160 | A | 6/1976 | Wilson | |
| 4,136,805 | A | 1/1979 | Storms | |
| 4,509,667 | A * | 4/1985 | Meldrum | 224/250 |
| 4,602,761 | A | 7/1986 | Carter | |
| 4,648,572 | A | 3/1987 | Sokol | |
| 4,666,194 | A | 5/1987 | Charman | |
| 4,696,447 | A | 9/1987 | Strecker | |
| 4,836,482 | A | 6/1989 | Sokol | |
| 4,863,130 | A | 9/1989 | Marks | |
| 4,865,237 | A | 9/1989 | Allen | |
| 4,896,855 | A | 1/1990 | Furnish | |
| 4,957,254 | A | 9/1990 | Hill et al. | |
| 4,984,760 | A | 1/1991 | Cohn et al. | |
| 5,115,382 | A | 5/1992 | Smith | |
| 5,174,483 | A | 12/1992 | Moore et al. | |
| 5,187,744 | A | 2/1993 | Richter | |
| 5,200,827 | A | 4/1993 | Hanson et al. | |
| 5,246,193 | A | 9/1993 | Faidley | |
| 5,285,938 | A | 2/1994 | Fauchald | |
| 5,386,960 | A | 2/1995 | O'Brien | |
| 5,390,837 | A | 2/1995 | Ruffolo | |
| 5,429,335 | A | 7/1995 | Cunningham | |
| 5,452,874 | A | 9/1995 | Kozloff et al. | |
| 5,529,271 | A | 6/1996 | Dunchock | |
| 5,653,336 | A | 8/1997 | Buonaiuto et al. | |
| 5,678,793 | A | 10/1997 | Hill | |
| 5,697,071 | A | 12/1997 | Fan | |
| D392,646 | S | 3/1998 | Takayasu et al. | |
| 5,806,816 | A | 9/1998 | Hull et al. | |
| D404,038 | S | 1/1999 | Fransson et al. | |
| 5,941,434 | A | 8/1999 | Green | |
| 5,996,950 | A | 12/1999 | Richter | |
| 6,010,102 | A | 1/2000 | Dillion | |
| D432,075 | S | 10/2000 | Hassett et al. | |
| D435,963 | S | 1/2001 | Fulmore | |
| 6,193,396 | B1 | 2/2001 | Winger et al. | |
| 6,237,885 | B1 | 5/2001 | Mitchell | |
| 6,330,948 | B1 | 12/2001 | Leto | |
| 6,369,952 | B1 | 4/2002 | Rallison et al. | |
| 6,560,029 | B1 | 5/2003 | Dobbie et al. | |
| 6,637,707 | B1 | 10/2003 | Gates et al. | |
| 6,745,925 | B2 | 6/2004 | Brzyski | |
| 6,779,765 | B2 | 8/2004 | Zheng et al. | |
| 6,825,875 | B1 * | 11/2004 | Strub et al. | 348/207.99 |
| 6,913,412 | B1 | 7/2005 | Byers | |
| 6,932,309 | B1 | 8/2005 | Corey et al. | |
| D524,042 | S | 7/2006 | Lavine | |
| 7,458,736 | B2 * | 12/2008 | Woodman | 396/420 |
| 7,810,783 | B2 | 10/2010 | Tsay et al. | |
| 7,857,268 | B2 | 12/2010 | Chiu | |
| 7,926,967 | B2 | 4/2011 | Spartano et al. | |
| D640,017 | S | 6/2011 | Mendelson | |
| 7,984,697 | B2 | 7/2011 | Grbic | |
| 2002/0090083 | A1 | 7/2002 | Grant et al. | |
| 2003/0115662 | A1 * | 6/2003 | Dobbie et al. | 2/422 |
| 2005/0045681 | A1 | 3/2005 | Hancock et al. | |
| 2007/0241246 | A1 | 10/2007 | Ristau | |
| 2008/0148621 | A1 * | 6/2008 | Laser | 43/4 |
| 2008/0149679 | A1 * | 6/2008 | Case et al. | 224/666 |
| 2008/0203263 | A1 | 8/2008 | Carnevali | |
| 2010/0155550 | A1 | 6/2010 | Weiss-Vons | |
| 2010/0232132 | A1 | 9/2010 | Centner | |
| 2010/0320341 | A1 | 12/2010 | Baumann et al. | |
| 2011/0139946 | A1 | 6/2011 | Gonzalez | |
| 2011/0198462 | A1 | 8/2011 | Pell | |
| 2013/0200118 | A1 | 8/2013 | Johnson | |
| 2013/0270129 | A1 | 10/2013 | Johnson | |
| 2013/0306689 | A1 | 11/2013 | Johnson | |
| 2013/0341412 | A1 | 12/2013 | Johnson | |

OTHER PUBLICATIONS

Various website printouts for head-mounted camera systems, at early as May 15, 2012.

Various website printouts for products, at least as early as Jan. 17, 2012.

Camera mounts, http://gopro.com/camera-mounts, at least as early as May 15, 2012, pp. 1-23.

* cited by examiner

HEAD MOUNT APPARATUS FOR HANDS-FREE VIDEO RECORDING WITH AN ELECTRONIC DEVICE

This application claims benefit of Provisional Application Ser. No. 61/647,412, filed May 15, 2012 and entitled "Head Strap Electronic Device Mounting System", and Provisional Application Ser. No. 61/656,356, filed Jun. 6, 2012 and entitled "Head Strap Electronic Device Mounting System", the disclosures of which are incorporated by this reference.

BACKGROUND OF THE INVENTION

1. Field of the Invention

The present invention generally relates to specialty holsters or holders for electronic devices that have video-recording capabilities. More particularly, the invention relates to apparatus for holding a portable electronic device, such as a cellular phone, smart phone, camera, or other digital media device, that may be strapped or otherwise secured to a person's head for hands-free use of the electronic device.

2. Related Art

There are many electronic device holsters, mounts, and carrying solution designs in the prior art. Still there is an absence of a head mounting apparatus and strap system that is operable with nearly all video-capable cellular smartphone designs. To the Applicant's knowledge, there has not yet been disclosed a universal smartphone head mount and strap system, that can hold video-capable cellular smartphone in the desired orientation for taking hands-free video.

With the development of information communication technology, cellular phones have become essential tools modern life. More recently, the cellular phone is provided with various functions, such as a camera, in addition to a function of simply calling or answering the telephone. The integrated camera has a variety of functions including video recording. Thus, the cellular phone is recognized as advanced video-recording equipment, going beyond the functionality of a traditional camera used solely for picture taking purposes.

At present, most of users taking self-video with cellular phones do so using their own hands, or have to place the phone upright on a flat surface. In the case of taking a video with a cellular phone with the hand, the users arm is not free to conduct other tasks, thereby limiting the preferred hands-free use. There are a variety of products that allow a phone to be placed on flat horizontal surfaces allowing picture taking. These include platforms, kickstands, holding mechanisms, and attachments for such uses. The existence of prior art designs associated with holding a phone during use, or attaching a phone to an object, vertical surface, or horizontal surface during use is apparent, as several such designs may be found in the patent database. However, the Applicant is not aware of any pre-existing patents that are similar to the invention, in design, structure, or in that they contain a universal mounting plate that would allow a person securely mount a wide array of differing electronic devices to a person's head for hands-free video taking purposes.

Primary problems with much of the prior art includes: adaptation only for specific, specialty-camera designs, being usable with only one type of device, and/or being complex or expensive. Applicant's preferred head-mount apparatus solves these issues in that is it small, lightweight, has limited potential for breakage, can be used with a high percentage of modern day smartphone devices, and is relatively inexpensive to manufacture.

With the vast array of smartphone sizes and varying locations of operational buttons, such a universal mounting plate requires specific and unique design features to accommodate such a broad array of smartphone devices. The preferred embodiment solves the stated issues in that employs a flexible strapping and plate system that can fit a high percentage of smartphones or other electronic devices with video functions, and that will secure the device with or without a case fastened to the device. Further, the preferred embodiment does not interact/interfere with the electronic device's operational buttons. With the advancement of cell phone technology, there is a need for a universal, convenient, and inexpensive head mount apparatus that is operable with most present day smartphones and other similar electronic devices, allowing for hands-free video. This invention addresses that need.

SUMMARY

The present invention comprises a head mount apparatus for holding an electronic device on a person's head in a desirable position for hands-free use as a video recorder. A unique mounting plate supports the electronic device and connects to a strap, cap, cover or other head unit adapted for comfortable and secure placement on/around the head.

The preferred head unit is a head strap assembly that includes straps that preferably are elastic and comprise loops or other fasteners/portions that attach to the mounting plate, for keeping the mounting plate in the preferred location generally centered on the wearer's forehead. The preferred head strap assembly may comprise a circumferential side-strap that is sized in length so that it may surround the head circumference and fasten to slots/arm-systems at both sides of the mounting plate by means of an open loop at each end of the side-strap. The preferred head strap assembly may also comprise a top-strap that connects to a slot/arm-system at the rear of the mounting plate and extends back to connect with the circumferential side-strap. An end of the top-strap may comprise a loop that is inserted onto the top-strap arms on the mounting plate and an adjustable tri-glide mechanism or other length-adjustment mechanism. An opposite end of the top-strap may comprise a loop through which the longer circumferential side-strap is passes for connection of the top-strap to the side-strap.

The preferred head strap assembly comprises left, right, rear, and top portions, wherein the mounting plate preferably serves as the connector between said left, right, and top portions. The head strap assembly encircles a person's head to an extent that retains the mounting plate with captured electronic device on the wearer's head. Thus, once the wearer has turned on the recording feature of the electronic device, the head mount apparatus provides a secure recording location for the desired electronic device, allowing for hands-free use.

The electronic device is captured in the head mount apparatus by use of a retention strap provided on the mounting plate, the combination of which will conform/fit most cellular phone devices having a video function, or similar electronic devices having video capabilities. Most preferably, the retention strap is both flexible (or substantially flexible) and elastic (or substantially elastic), wherein the flexibility and elasticity adapts certain embodiments of the apparatus to fit many different electronic devices. Alternatively, the dimensions of the plate and/or retention strap may require slight alteration to optimally-accommodate the electronic device.

In certain embodiments, the retention strap fastens in a tightened configuration by means of patch(es) of hook/loop fastener. The strap's elasticity, and the leeway in connection location provided by hook/loop fastener, allow the user to tighten the retention strap around/against the device to hold the device securely in place on/against the mounting plate mechanism. The retention strap may connect to one portion of the mounting plate, and loop through another portion(s) of the plate to form a space between the strap and the plate for receiving the electronic device. After looping through said another portion, the retention strap may attach to itself in the tightened configuration for capturing the electronic device. In certain embodiments, the retention strap extends from a retention strap arm-system of the upper region of the mounting plate mechanism, downward along the front side of the mounting plate, through a slot opening at the lower front of the mounting plate, around a lower support platform, and then back up (outside and along the downwardly-extending portion of the retention strap) to connect to cooperating hook/loop fastening material at a location on the upper portion of the proximal end of the retention strap. Alternatively, other fasteners and fastener locations for latching/securing the retention strap in a tightened configuration may be used, for example, hook-and-loop cooperating patches at other locations on the strap, or fastener(s) on the mounting plate that cooperate with a fastener(s) on the retention strap.

The mounting plate assembly may be specially-adapted so that capturing the electronic device does not press buttons that will mistakenly operate device functions. For example, the mounting plate may have protrusions and/or recesses located so that they prevent buttons of the electronic device from being pressed when the device is tightly captured between surfaces of the plate and the retention strap.

While the following description details preferred embodiments, it will be understood that such detail need not be strictly adhered to, but that additional changes and modifications may suggest themselves to one skilled in the art, all falling within the scope of the invention as defined by the claims.

BRIEF DESCRIPTION OF THE DRAWINGS

The following description of the apparatus can be understood in light of the Figures, in which.

DETAILED DESCRIPTION

Figure 1:
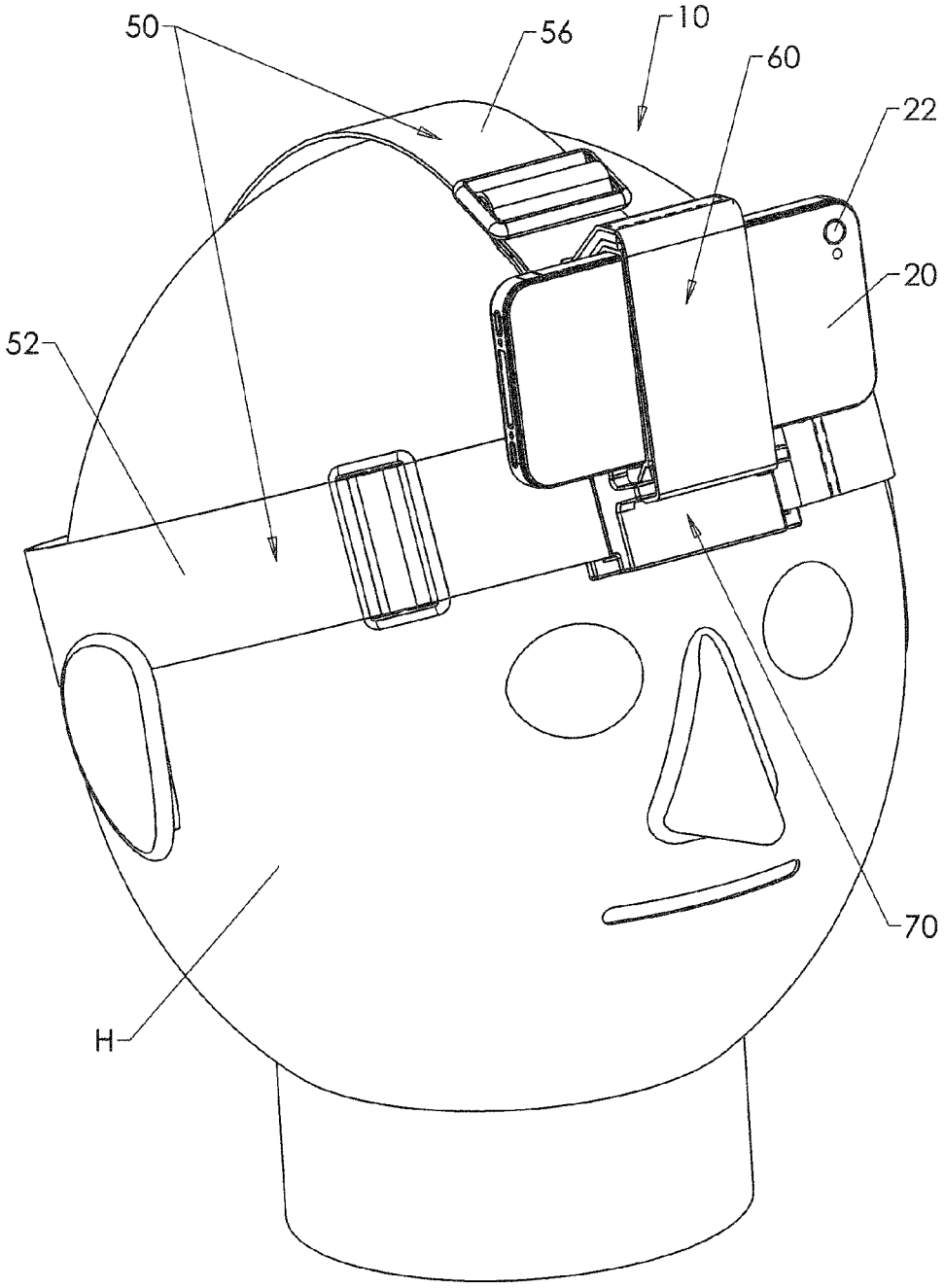
FIG. 1 is a front isometric view of one embodiment of the invented head mount apparatus, being worn on a human head, comprising an elastic head strap assembly and a mounting plate assembly capturing an electronic device.
Figure 2:
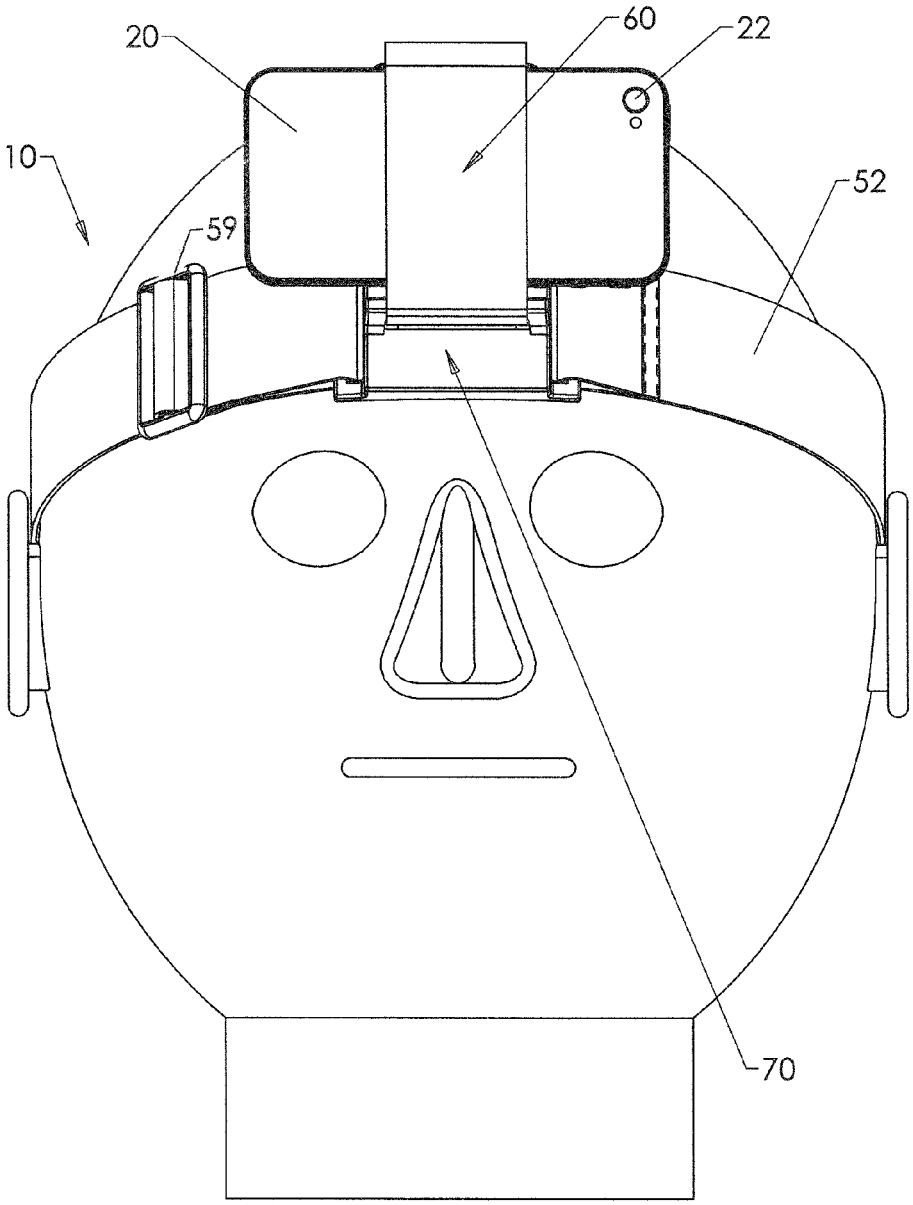
FIG. 2 is a front, view of the embodiment depicted in FIG. 1.
Figure 8:
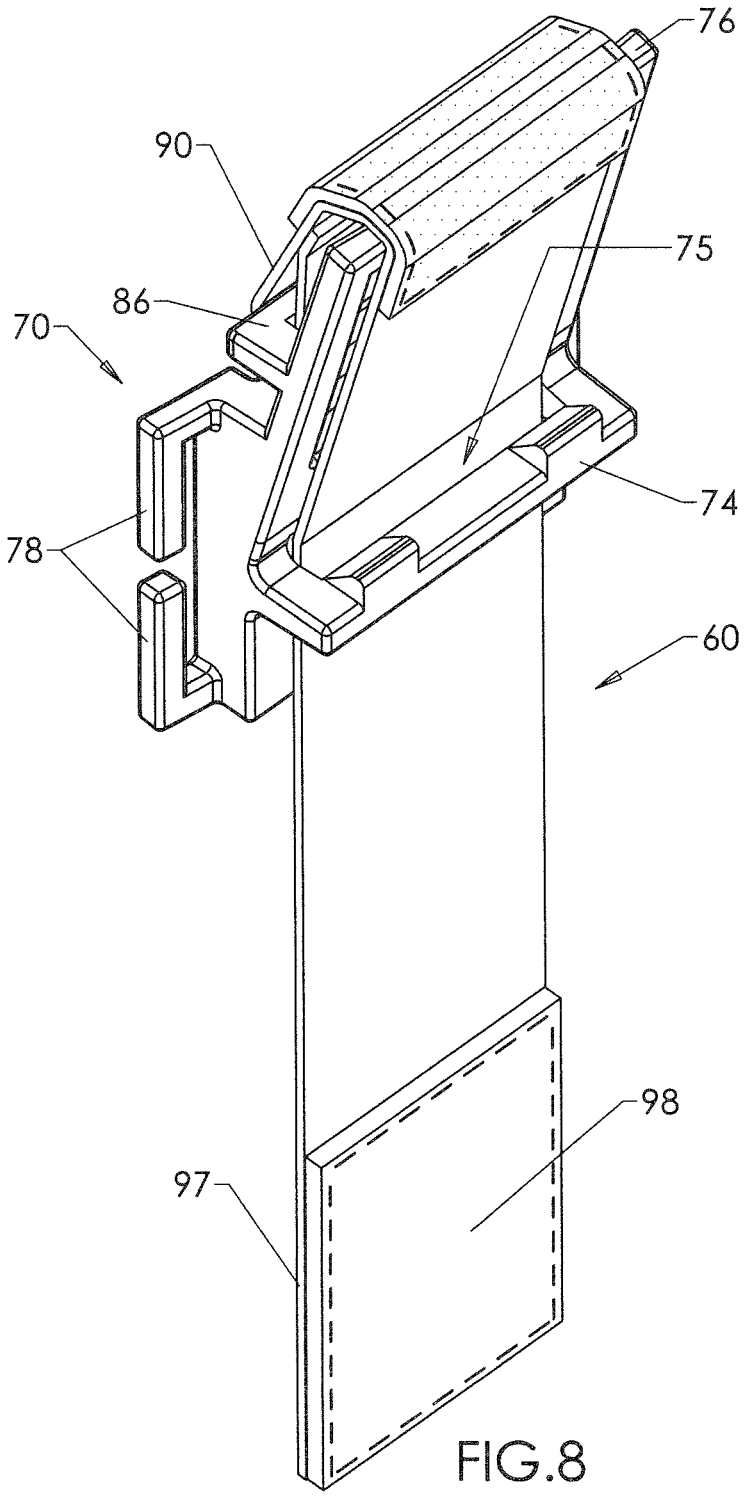
FIG. 8 is a front isometric view of the mounting plate assembly of the embodiment of FIG. 1, separated from the head strap assembly and without the electronic device, wherein the retention strap is unlatched and extended as in FIG. 7.
Figure 9:
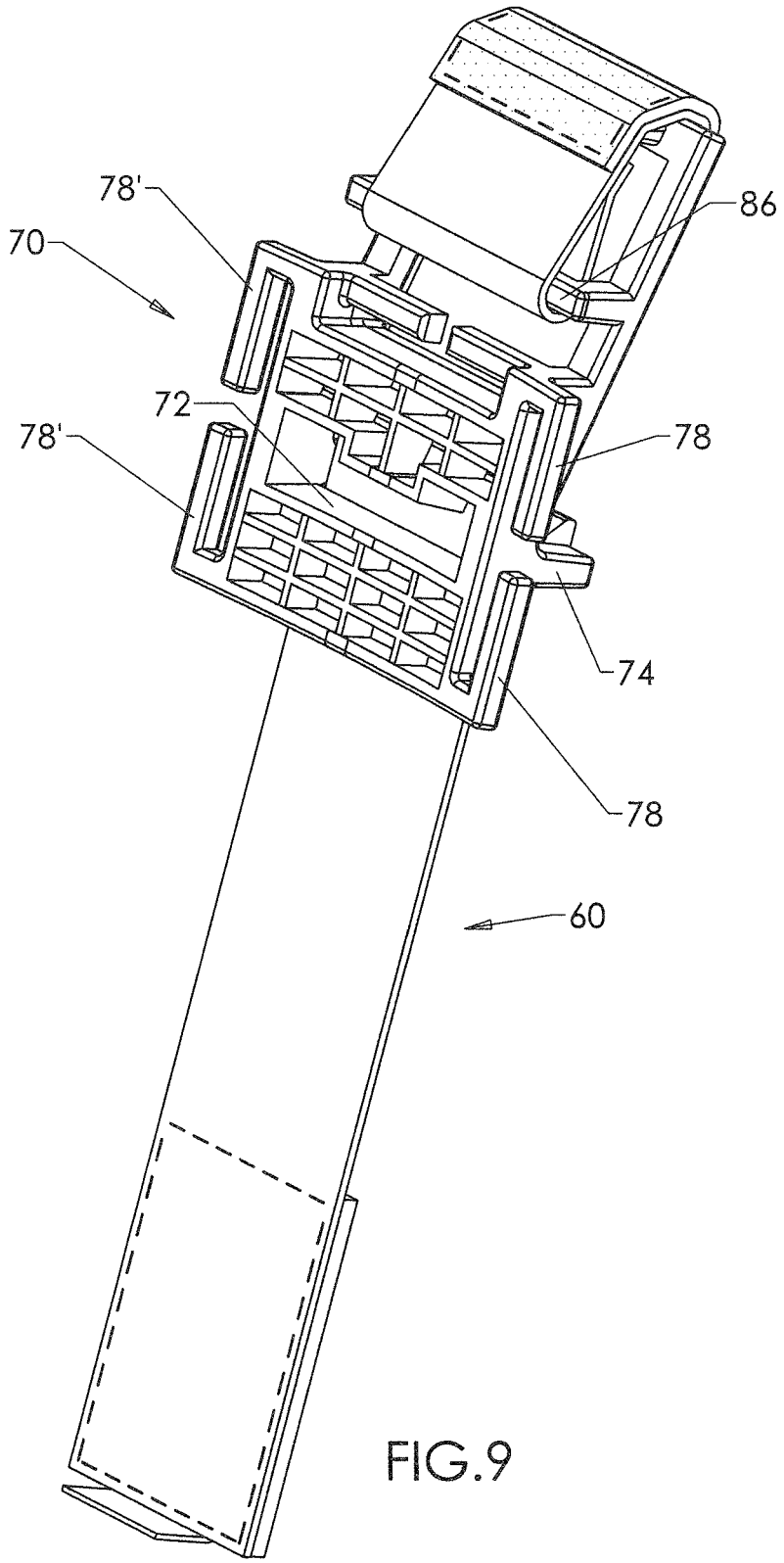
FIG. 9 is a rear isometric view of the mounting plate assembly of the embodiment of FIG. 1, separated from the head strap assembly and without the electronic device, wherein the back of the mounting plate is clearly shown with cushion pad removed and wherein the retention strap is unlatched and extended as in FIGS. 7 and 8.

Referring specifically to the Figures, there is shown one, but not the only, embodiment of the invented head mount apparatus for securing an electronic device that preferably contains video recording capabilities. The head mount apparatus comprises a mounting plate assembly, and a head strap assembly for being worn on a user's head (FIGS. 1 and 2). The head mount apparatus is shown removed from the wearer but still holding an electronic device in FIGS. 3-5. The head mount apparatus is shown removed from the wearer and without the electronic device phone in FIG. 7. FIGS. 6, 8, and 9 shown details of the mounting plate assembly and FIGS. 10-13 shown details of the mounting plate alone.

FIG. 1 is a front, isometric view of the preferred embodiment of head mount apparatus, that is, head-mount device 10, being worn on a person's head H, wherein electronic device 20 is secured in the holster to allow for hands free video recording, and lens 22 is directed forward to the wearer's general field of view. The electronic device 20 is securely held in place within mounting plate 70 by the elastic retention strap 60.

The head strap assembly 50 includes adjustable circumferential side-strap 52 and top-strap 56, with both straps structured for a wide range of independent length adjustments, to fit differently-sized heads, through the use of tri-glide adjustable mechanisms 59, 59'. The longer strap, side-strap 52, extends generally in a circle for fitting circumferentially around the person's head. The shorter strap, top-strap 56, extends from at or near the front of the side-strap 52 to the rear of the side-strap 52, for fitting over the top of the person's head. The head strap assembly 50 is attached to the centrally-located mounting plate 70, by means of straps 52 and 56 connected to, and extending from, the sides and an upper region of the mounting plate 70, respectively.

FIG. 2 depicts a front view of the device in the orientation and use of FIG. 1 with electronic device 20 securely retained within the mounting plate via the elastic retention strap 60. The side-strap 52 contains two loops, one at each end, which act as the connection method between the side-strap 52 and the head plate 70, while retaining adjustability to fit a variety of head sizes by integration of the tri-glide mechanism 59. The orientation of the lens 22 is depicted in the preferred exposed location and direction to capture the general field of view of the wearer.

Figure 3:
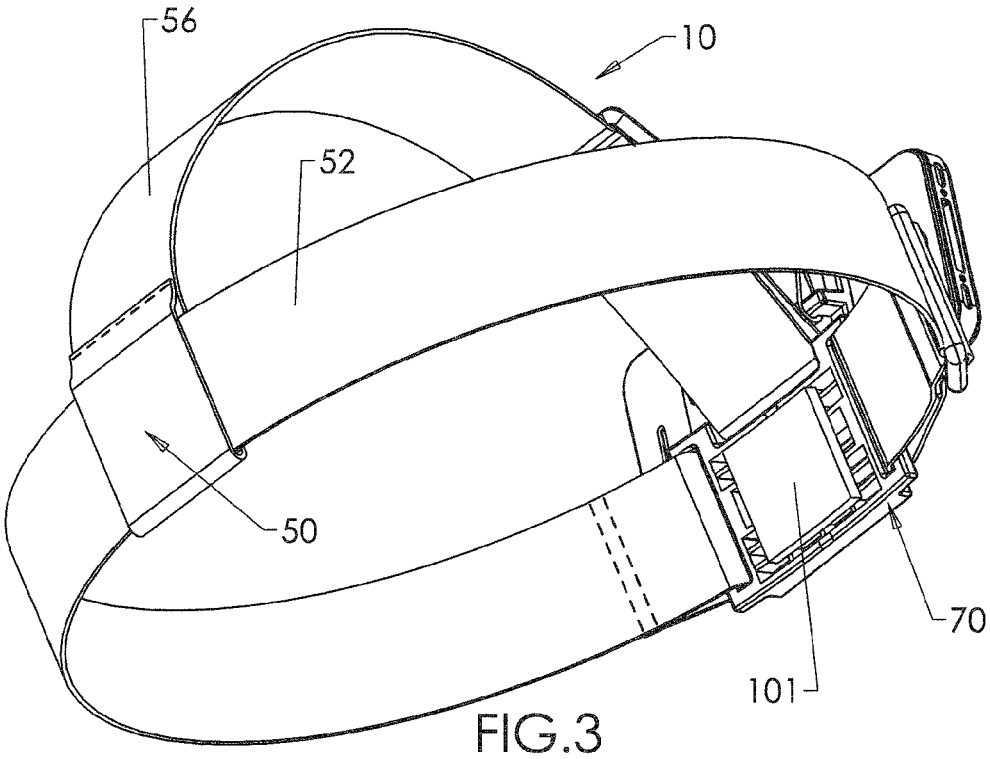
FIG. 3 is a rear, bottom isometric view of the embodiment of FIG. 1 removed from the wearer's head.

FIG. 3 illustrates a rear isometric view of the device 10, with the inserted electronic device in place, but removed from the human head. FIG. 3 shows to best advantage the relative positions/locations of head strap assembly 50 and the mounting plate 70. The top-strap 56 comprises an additional loop at its distal (rear) end that connects to the side-strap 52 by means of side-strap 52 passing through this distal loop. The top-strap 56 and side-strap 52 are preferably connected in this manner prior to connection with the mounting plate 70. This loop-connection method, between the distal end of top-strap 56 and the side-strap 52, allows the straps to maintain the desired adjustability to accommodate a wide spectrum of head sizes/diameters.

The back of the mounting plate 70 is shown in FIG. 3, with attached pad 101 that provides additional comfort for the wearer. Due to the rigidity of the mounting plate, it is preferred that a rectangular, adhesive-backed foam pad 101 is adhered to the back of the plate where the part comes in contact with the forehead of a person wearing the device. The device will function properly without such a pad 101, but the intention is to increase the comfort of the device 10 while being worn. The general thickness of the pad 101 would preferably be at least ⅛" thick, and could potentially be thicker if so desired. The dimensions of the pad 101 could be altered to accommodate the size of the mounting plate 70, and would preferably cover the back section of the mounting plate 70, but would not interfere with the adjacent straps 52, 56 or their attachment to the mounting plate, for example, at the slots/arm-systems.

Figure 4:
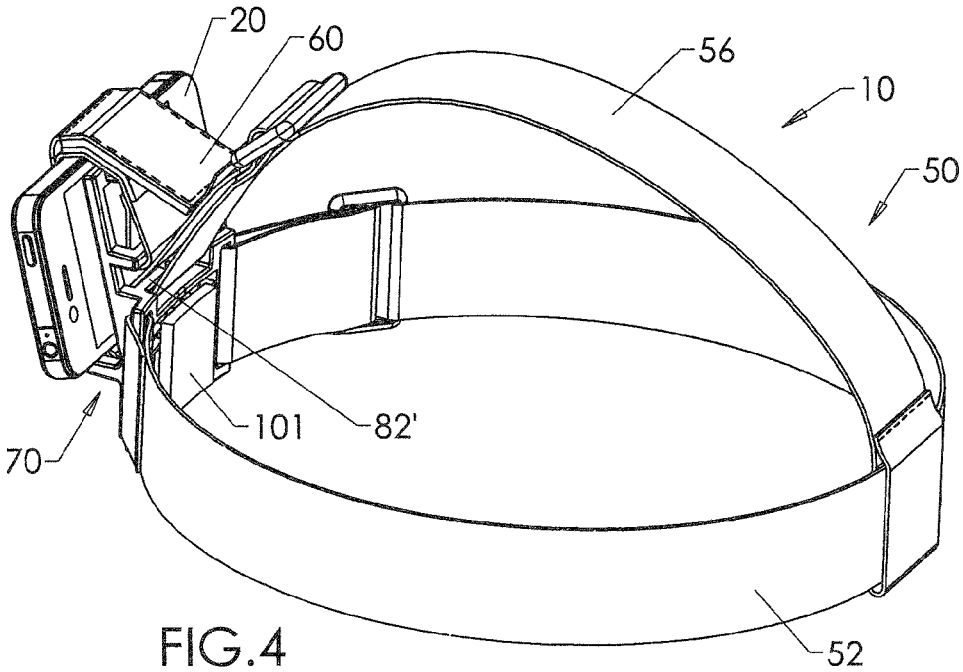
FIG. 4 is a right side isometric view of the embodiment of FIG. 1.

FIG. 4 shows to best advantage the insertion attachment point between the top-strap 56 and the mounting plate 70, wherein the loop at the front (proximal) end of the top-strap 56 attaches to top-strap arms 80 (not visible in FIG. 4) and 82' (visible in FIG. 4). As is visible in FIG. 4, but is described in more detail later in this document, the distal end of the elastic retention strap 60 extends over the electronic device 20 generally rearward to fasten to a patch of hook/loop fastener of the retention strap proximal end to tighten the retention strap 60 tightly around the electronic device 20.

Figure 5:
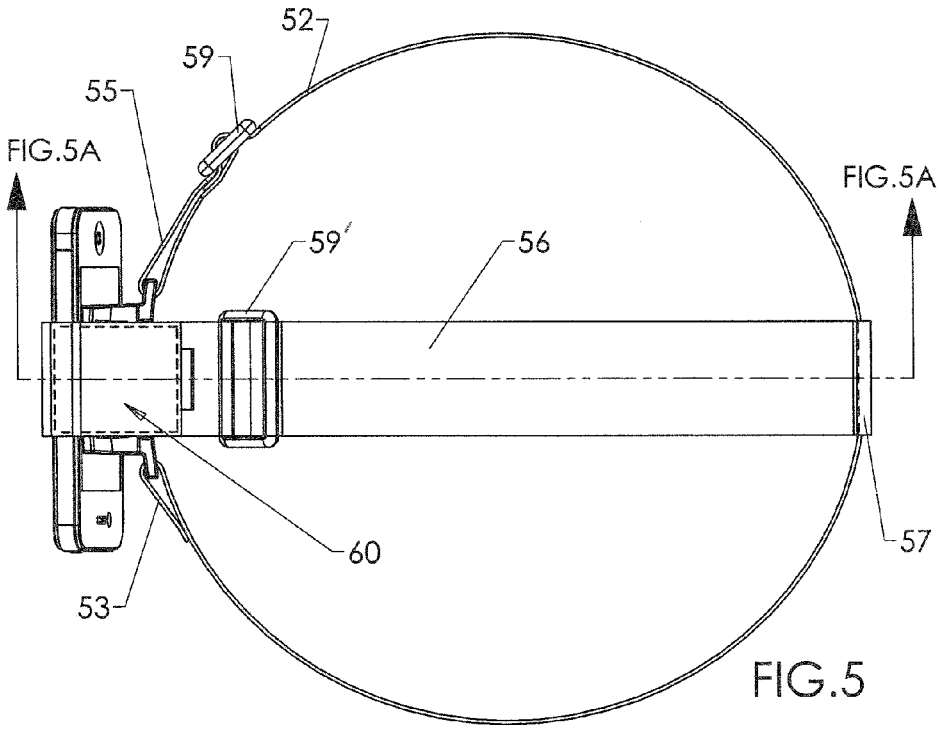
FIG. 5 is a top view of the embodiment of FIG. 1, wherein this figure demonstrates the preferred orientation of the head strap assembly relative to the mounting plate.
Figure 6:
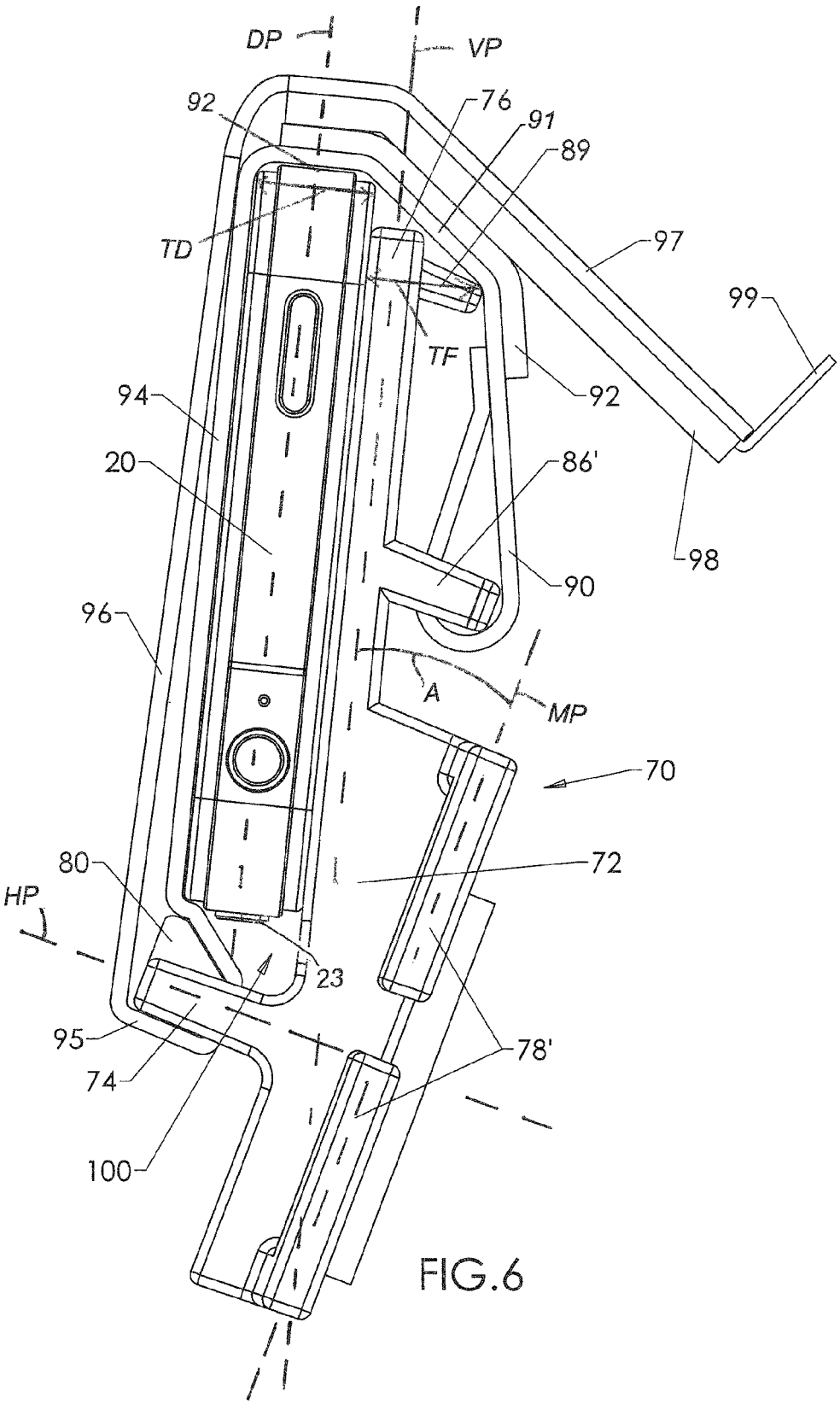
FIG. 6 is a side view of the mounting plate assembly of the embodiment of FIG. 1, separated from the head strap assembly, showing to best advantage the electronic device placed into the space between the mounting plate and the retention strap and resting on top of small triangular knobs/protrusions that keep buttons on the phone from being compressed.

FIG. 5 illustrates a top view of the device 10 illustrating the preferred connection and orientation of the top-strap 56 and side-strap 52 relative to the mounting plate 70 and electronic device 20. The connections (also called "insertion points" due to loops of the straps being inserted between arms of their respective arm-systems) between the mounting plate 70 and the ends of the side-strap 52 are best shown here with the loops 53 and 55 attached to the side-strap arms 78, 78' by passing through side-strap slots 79, 79' to encircle the arms 78, 78'. Also, see FIG. 11 for a good view of the side-strap arms 78, 78' and slots 79, 79'. When side-strap 52 is securely attached to the mounting plate via the loops 53 and 55, the resulting orientation of the preferred side-strap creates a large circular opening into which the wearer will insert his/her head. The side-strap 52 provides necessary support to the mounting plate, thereby limiting any unwanted shaking, or movement of the mounting plate to maintain the preferred tight fit against the wearer's head while recording video.

The top-strap 56 also acts to secure the apparatus at the preferred location on the person's head, by the strap extending over the top of the person's skull, thereby limiting the location of the attached side-strap 52 to the region above the person's ears, which is generally preferred. At the rear end of the top-strap 56 is sewn loop 57, through which side-strap 52 passes and slides, thereby allowing the two straps to be joined while maintaining a slidable connection and some adjustability between the straps 56 and 52. As shown to best advantage in FIGS. 4 and 5A, the front end 58 (also "front end loop 58") of top-strap 56 loops around arms 82, 82', through slot 84, to connect the top-strap 56 to the plate 70. Also, see FIG. 11 for a good view of the arms 82, 82' and slot 84.

Figure 5A:
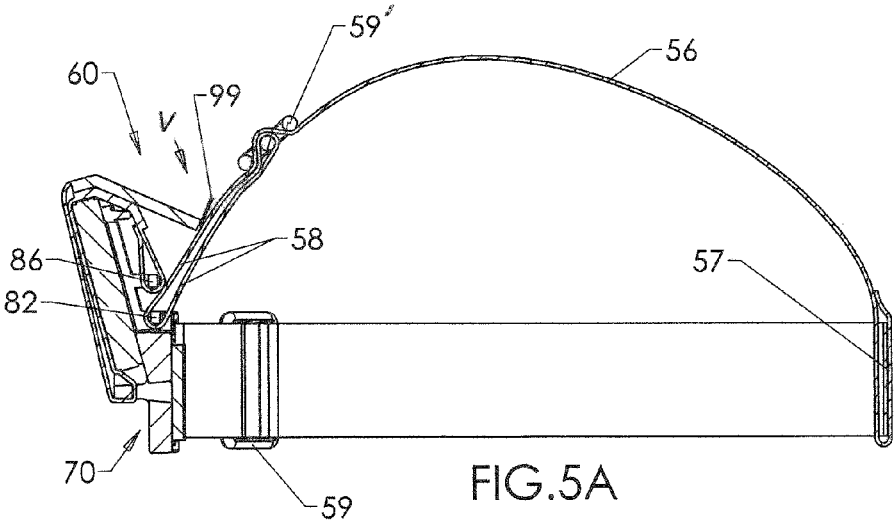
FIG. 5A is a cross-sectional side view of embodiment of FIG. 1, viewed along line 5A-5A in FIG. 5.

FIG. 5A illustrates a side cut away view of the embodiment of FIG. 5 depicting the top-strap front end loop 58 connection with the top-strap arms 82 (82' hidden) of the mounting plate 70. The loop 57 at the opposite end (rear/distal end) of the top-strap 56 is also shown here with the side-strap inserted through the loop. The top-strap 56 comprises a tri-glide mechanism 59' to allow for adjustability as needed to accommodate differently-sized heads. An end of the strap 56 is sewn in place to the central portion of the tri-glide 59', and the strap 56 is inserted through the openings within the tri-glide mechanism 59 to allow for the mechanism to slide along the strap 56 to maintain adjustability.

The mounting plate 70 is depicted in FIG. 5A, illustrating the preferred orientation of the elastic retention strap 60 as it is wrapped around the electronic device 20. See also FIGS. 6-9. A loop at one end of the retention strap 60 is attached to the top-strap arms 86, 86', which are located at the back of the upper region of the vertical support platform 76 that extends upward from the main body of the mounting plate 70. Said loop of the retention strap 60 extends through slot 87 in order to loop around arms 86, 86'.

FIG. 6 illustrates a side view of the mounting plate assembly, depicting the electronic device 20 secured in place on the mounting plate 70 by the retention strap 60. One may see in FIG. 6 to best advantage that the lower support platform 74 and the vertical support platform 76 are joined or integral with each other and form a generally L-shaped mounting plate cradle for receiving the electronic device 20. Support platform 74 and support platform 76 extend at an angle relative to each other in the range of about 75-82 degrees (angle of HP to VP in FIG. 6), so that the cradle for the device 20 may be described as the 75-82 degree space between HP and VP. The rearward surface of the electronic device 20 rests against the front surface of the vertical support platform 76, which extends upward from mounting plate main body 72. The lower end/edge of the device 20 rests near the intersection of HP and VP, against a portion of the retention strap 60 pulled against the lower support platform 74.

The retention strap 60 is connected to the mounting plate 70 by means of a slot/arm-system connection, in a similar manner as the connection of side-strap loops 53, 55 to arms 78, 78'. Proximal end 90 comprising a loop that passes through slot 87 and around strap arms 86 (not visible in FIG. 6) and 86' (visible in FIG. 6) that are located at the back of the upper region of the vertical support platform 76. Note that arms 86, 86' extend toward each other, but do not meet, thus forming a gap between their inner ends for insertion of the loop of proximal end 90. This preferred slot/arm design is intended to allow quick and easy connection and disconnection of the strap 60 to the mounting plate 70. Said connection and disconnection is performed, when desired, by manipulating the loop through the gap between the arm inner ends.

When the proximal end of the retention strap 90 is connected correctly, the proximal patch of hook fastener 92 sewn in place at or near the proximal end 90 is exposed, that is, facing out. Once the strap loop 90 is connected at the preferred arm 86, 86' location, the strap is then pulled upward and forward over the top of the vertical support platform 76, allowing the inner front portion 94 of the strap 60 to contact the front of the electronic device 20. The side of the inner front portion 94 of the strap 60, which is contacting the device 20, is the preferred side of the strap provided with silicone material or other gripping material, to create the desired "grippy" connection between the portion 94 and the device 20. The strap 60 continues to extend downwards through the loop slot opening 75 between the main body 72 of the mounting plate and the lower support platform 74. See slot opening 75 FIGS. 8 and 10.

The electronic device 20 is inserted into the space between the front face of the vertical support platform 76 and the inner front portion 94 of the retention strap so that the device 20 is centrally aligned with the mounting plate 70, with device 20 in a landscape orientation. In other words, the vertical centerline of device 20 is preferably aligned and parallel to the vertical centerline of the vertical support platform 76.

Once the electronic device 20 is inserted into the mounting plate assembly, specifically in the space between the vertical support platform and the inner front portion 94, the outer front portion 96 of the strap 60 is extended forward around the lower support platform 74, and upward along portion 94 (so that portion 96 overlaps portion 94) and rearward over the top of the device 20 and over patch 92 of the strap 60. The distal end 97 of the strap 60 may be pulled to fasten its now-downwardly-facing patch 98 of hook and loop fastener (typically loop fastener) to connect with the upward-facing patch 92 of hook and loop fastener (typically hook fastener). Thus, strap 60 may be pulled tight and secured generally in the position shown in FIG. 6, which pushes the device 20 against the vertical support platform 76 and down against the strap-covered lower support platform 74. The length of the retention strap 60 is intended to be of sufficient length to accommodate larger devices that have a longer width dimension (the shorter dimension of the device, generally up and down in FIGS. 2 and 6). due to the elastic qualities of the strap and the size of the patch 98 of hook fastener that has been specifically lengthened to ensure sufficient surface area to accommodate these larger devices.

Tensioning knobs 89 protrude rearward from at or near the rear side of platform 76. These knobs 89 are adapted to maintain the preferred orientation of the retention strap 60 near the top end of the device 20, and may be described as "rearward-tensioning" knobs. These knobs 89 affect the orientation of strap portion 91 between the tip of the knobs 89 and the top end 92 of the device 20, which may be seen to best advantage in FIG. 6. The knobs result in said orientation of strap portion 91 being more horizontal than it would be without the knobs 89, and result in a more-rearward vector of force on the top end 92 of the device 20. This more rearward force tends to keep the device 20 pivoted rearward a maximum amount in the mounting plate "cradle", that is, resting against the platform 76 front surface rather than tipping forward in the cradle. Another way of describing the structure and function of these tensioning knobs 89 is that knobs 89 protrude rearward a sufficient distance (preferably about ¼-⅝ inch, and more preferably about 5.8 inch) to provide the desired amount and/or desired direction of tension in the retention strap 60, especially in portions 91 and 94, ensuring that the device 20 is tightly held against the front surface of the vertical support platform 76. One or more alternative rearward-tensioning members may be provided, for example, a solid bar or a bracket protruding rearward, or simply making the top bar member of the frame of the platform 76 thicker in the front to rear direction, wherein said alternative rearward-tensioning members would be adapted to increase the rearward force vector supplied by the tensioned strap 60 on the top end 92 of the device. For example, it is preferred that the total thickness TF of the platform 76 frame including the knob thickness/length will be approximately 0.8-1.2 times the thickness TD of the top end 92 of the device 20.

It is shown to best advantage in FIG. 6 that the head mount apparatus retains the device 20 in an orientation with a slight forward tilt relative to the orientation of the main body 72, wherein the main body 72 is for resting against the wearer's forehead. It may be noted that the orientation of the mounting plate assembly in FIG. 6 is not quite the same as it would be during use against the wearer's forehead. The "plane" of the wearer's forehead could be described as "generally vertical" but it will be understood that the forehead plane will vary in its orientation relative to true vertical depending on the wearer's head structure and, of course, his/her stance and position during video recording. For example, a wearer's forehead plane may often be slanted rearward (the top being rearward of the bottom of the plane) up to about 10 degrees, for example. Therefore, in use, the mounting plate assembly would be rotated to the left of its position in FIG. 6 to place the main body plane MP vertical, showing that the plane of the vertical support platform VP, and likewise the plane of the device DP, would be tilted toward the left in FIG. 6. The "slight forward tilt" of the device plane DP, in use, is preferred to allow the camera lens to capture the general field of view of the wearer. An alignment that is perfectly plumb, or parallel, to the plane MP of the main body 72 would result in an undesirable direction for the camera lens, and such an orientation would not therefore capture the general field of view of the wearer. The "slight forward tilt" of the vertical support platform 76 plane VP relative to the plane MP of the main body 72 is preferably an angle A of approximately about 5-30 degrees, more preferably 10-25 degrees, and most preferably about 15 degrees. Therefore, assuming the wearer's forehead is slanted backward at most 10 degrees, an angle A of 15 degrees would still place the vertical support platform plane VP and the plane DP of the device slightly forward, for better video recording of the surroundings of the wearer.

One should note the location of the lower edge of the device 20 as it rests in the "cradle" of the mounting plate 70. With varying designs of smartphone devices, the operational buttons are often located along the side edges of the device. Such buttons are often utilized for functional features associated with the device such as camera zoom, on/off, or other functions. As such, it is preferred that these buttons are not compressed during video recording. Such compressing interactions with the lower support platform 74 or other portions of the mounting plate assembly could result in undesirable consequences, such as unwanted zoom, or accidentally turning the device off during use, thereby limiting the ability of the user to successfully record video. The preferred orientation of the device 20 therefore ensures that resting and tightening the device 20 in the mounting plate assembly, does not compress the buttons, for example, by having the buttons reside in an otherwise empty space, with a corner edge of the device resting on the mounting plate or a strap on the mounting plate.

Specifically, in the preferred embodiment, this avoidance of functional buttons is accomplished by knobs 80 extending from lower support platform 74. Lower support platform 74 protrudes generally forward from the main body 72 at about ⅔ of the way down the length of the mounting plate 70. Protruding knobs 80 (visible in FIG. 6) are generally triangular in shape and are designed to create an open space 100 below the electronic device 20. Open space 100 provides space for certain functional/operational buttons 23 of the electronic device 20 to reside, whereby the buttons 23 avoid contact with the support platform 74 and all portions of the mounting plate assembly. Thus, knobs 80 limit the amount of surface area interacting between the lower region of the device 20 and the lower support platform 74 itself. The strap 60 extends from the front of the device 20 rearward and downward along the sloped side of the knobs 80, so that the buttons 23 also avoid contact with the strap 60. The knobs 80 and the lower support platform 74 are preferably smooth, to allow the strap 60 to easily slide across the surface of the knobs and platform 74, for effective tightening of the strap 60.

Figure 7:
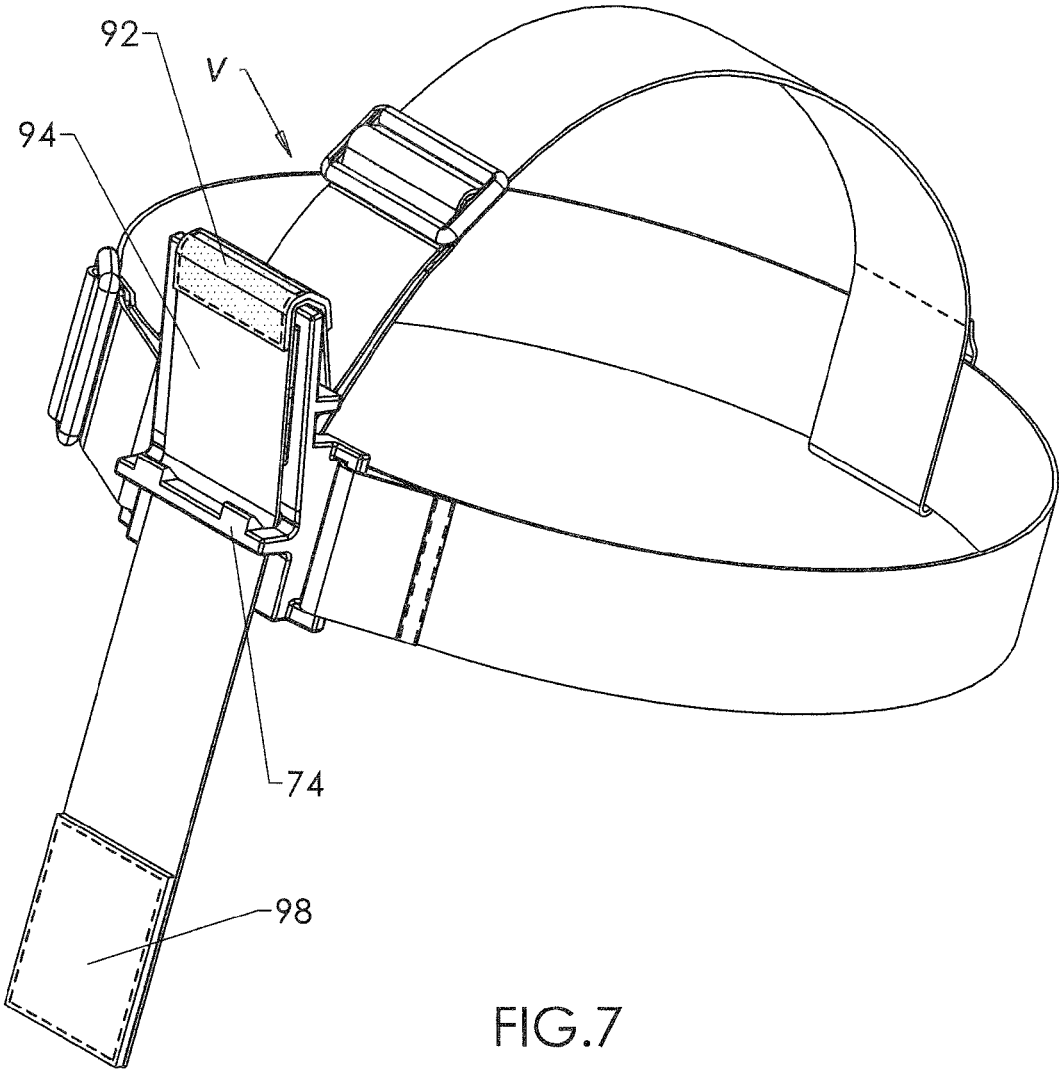
FIG. 7 is an isometric view of the embodiment in FIG. 1, without the electronic device, wherein the longitudinal elastic retention strap is "unlatched" and extending down through the slot opening in the lower support platform of the mounting plate.

FIG. 7 illustrates a front isometric view illustrating the preferred location of the patch 92 of hook fastener sewn in place at the proximal end of the strap 60 and facing outward/upward. At the distal end of the retention strap is sewn in place the corresponding patch 98 of loop fastener, which is outward facing in FIG. 7. In FIG. 7, one may see to best advantage how the strap 60 extends through slot 75 between the outermost end of lower support platform 74 and the main body 72 of the plate 70.

FIGS. 8 and 9 illustrate the mounting plate assembly, removed from the head strap unit 50 and not holding an electronic device, with retention strap 60 extended downward from the mounting plate 70, for example, before placement of an electronic device 20 in the mounting plate assembly and before the strap 60 is tightened by "cinching" it upward and rearward for fastening. One may understand that the "cinching" action may be done prior to placing the apparatus 10 on the wearer's head, for example, by the user holding the main body 72 of the mounting plate (for example, clasping the body 72 at the arms 78, 78' in one hand) and pulling the strap 60 up tight around the device 20, and then swinging the distal end of the strap 60 rearward to fasten against patch 92. This action and the reverse action (to unfasten strap 60) are also convenient while the apparatus 10 is on the head, as the wearer can easily clasp the body 72 in one hand and grasp the strap 60 and/or its handle 99 to accomplish fastening or unfastening. One may see to best advantage in FIGS. 5, 5A, and 6, that the distal end of the strap 60 and its handle 99, in the fastened orientation, are in the easily-accessible (and easily-findable without looking in a minor) "V" space V between the device 20 and the wearer's head or between the device 20 and the top-strap 56.

The retention strap 60 may range from very flexible (such as cloth, elastic, thin rubber band, etc) to only somewhat flexible as required for various electronic devices. One side of the retention strap preferably includes a silicone or other gripping material, for gripping the device 20. A handle 99 is preferably provided at the outer end extremity of the strap 60, for easier grasping of the strap 60 by a user. The handle 99 may be a flexible fabric tab or other flexible extension, such as visible in the views of FIGS. 5A, 6, and 9, FIGS. 10-13 illustrate details of the preferred mounting plate 70. Generally rectangular main body 72 has a cored-out rear surface, which is desirable for polymeric ("plastic") injection molding techniques to aid in the proper cooling of the molded part. This is very common for plastic molded parts, and therefore these cored out cavities do not serve any specialized functional purpose. Not shown in FIGS. 10-13 is adhesive rectangular pad 101, intended to be applied to this rear surface area, thereby covering up these cavities and creating a smooth surface at which the mount connects with the forehead of the wearer. The main body may be described as having a main body plane MP (FIG. 6), but, as shown to best advantage in FIG. 12, the rear surface of the mounting plate 70 is slightly curved to conform to the general shape of a person's forehead.

Also shown to good advantage in FIGS. 10-13 are L-shaped side-strap arms 78, 78' protrude from right and left sides of the main body, generally in the plane of the main body 72. Slots 79, 79' reside between the arms 78, 78' and the main body. Top-strap arms 82, 82' protrude from an upper portion of the main body, generally in the plane of the main body 72, with slot 84 residing between arms 82, 82' and the main body. L-shaped retention strap arms 86, 86' protrude rearward from the vertical support platform 76 to be generally (but slightly forward) of the plane of the main body 72. The two arms of each set of arms extend toward each other but preferably do not meet or touch, leaving a gap for insertion of the respective strap loop, as will be understood after viewing the drawings.

Figure 10:
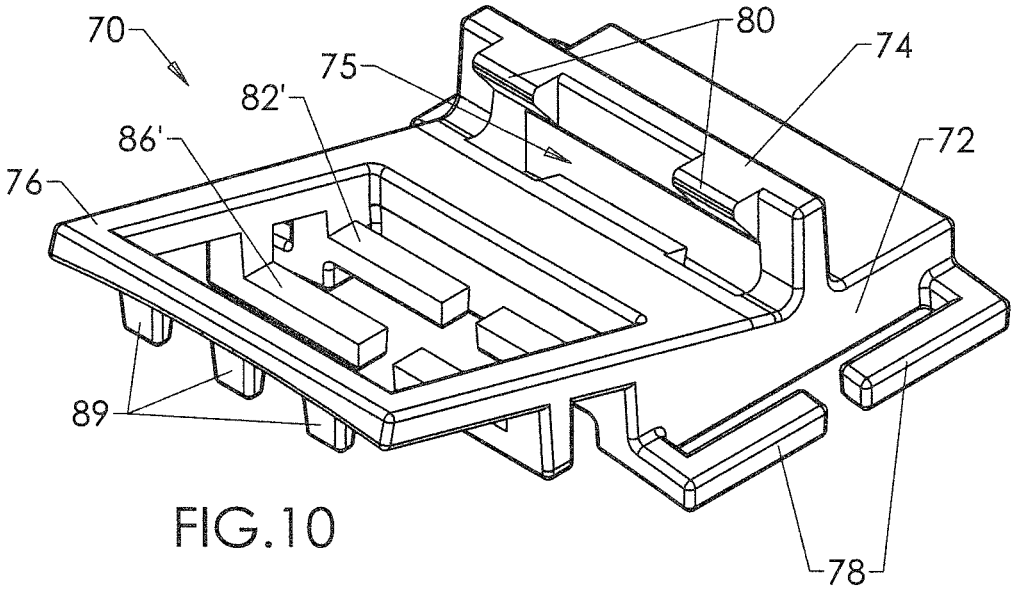
FIG. 10 is a side isometric view of the mounting plate of the embodiment of FIG. 1.
Figure 11:
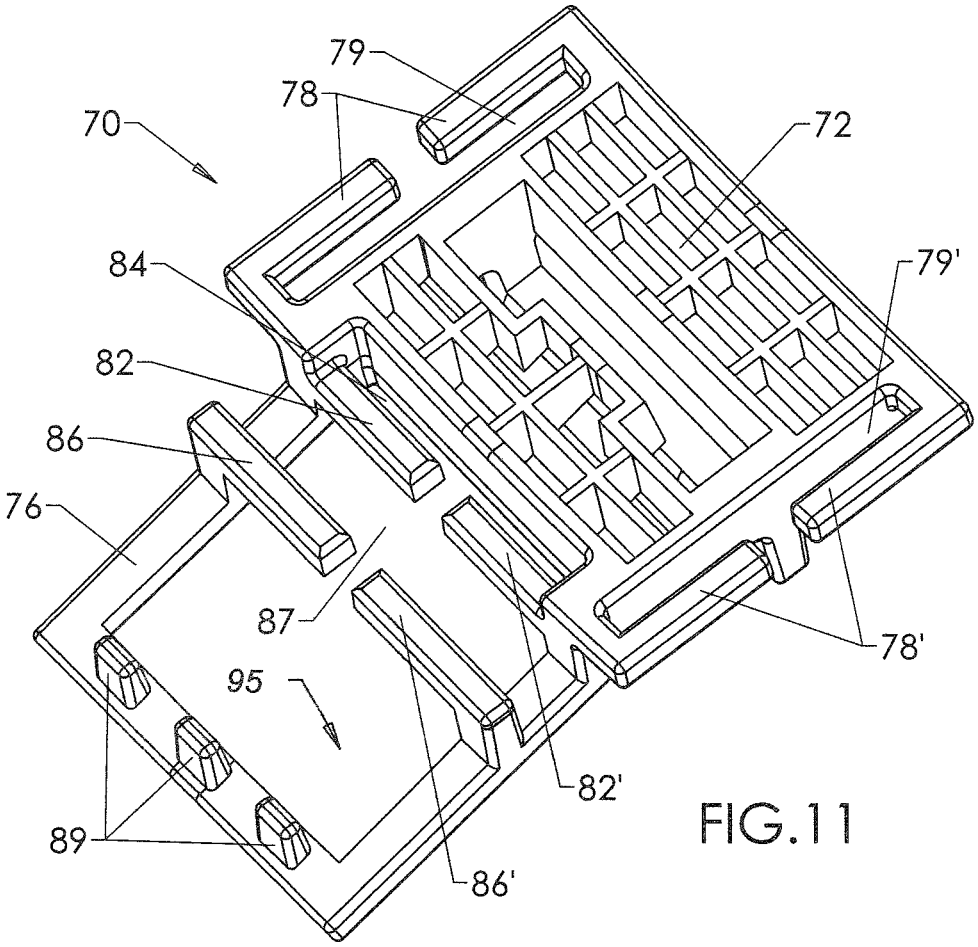
FIG. 11 is a rear isometric view of the mounting plate of the embodiment of FIG. 1.
Figure 12:
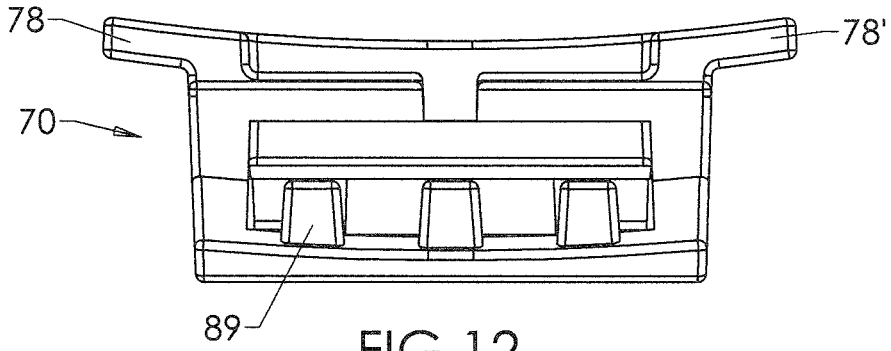
FIG. 12 is a top view of the mounting plate of the embodiment of FIG. 1.
Figure 13:
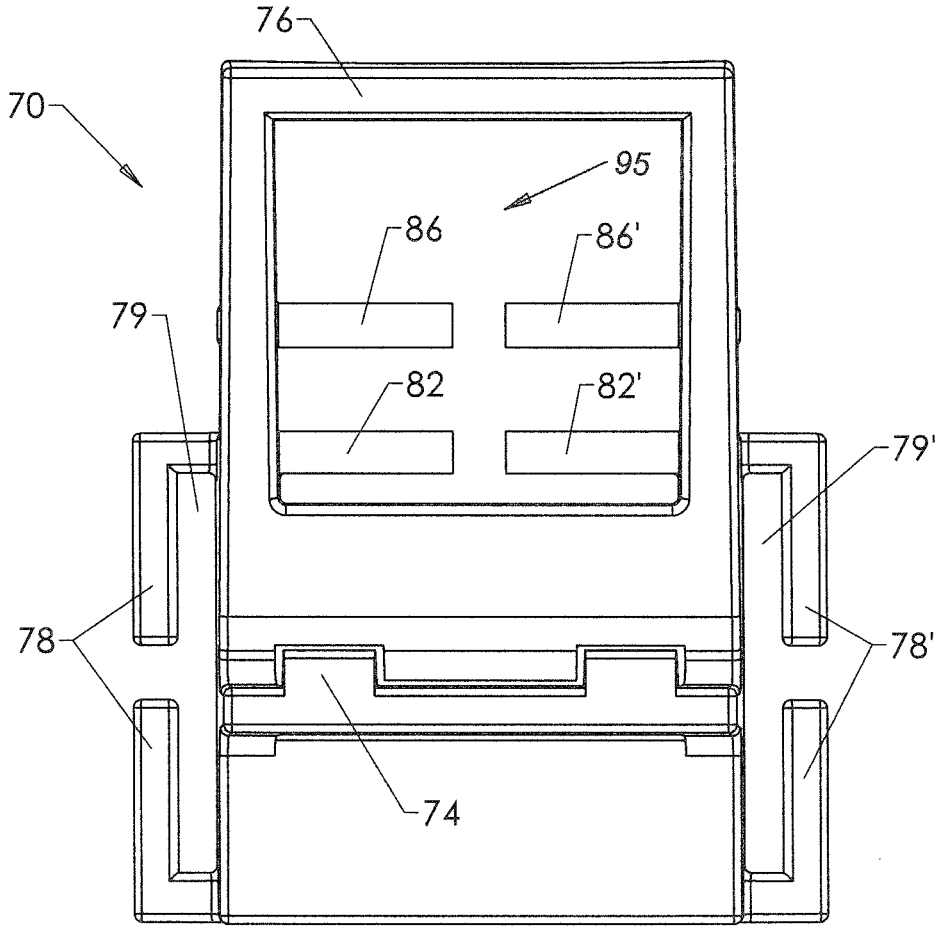
FIG. 13 is a front view of the mounting plate of the embodiment of FIG. 1.

It may be seen to best advantage in FIGS. 10 and 13 that the preferred vertical support platform 76 may be described as an open frame that upends from the main body 72 of the mounting plate 70. Platform 76 comprises left and right side bars/members, and a top bar/member that connects (preferably integral with) the top ends of the left and right side bars/members. These bars/members surround and define an open interior space 95, open at both the front and rear of the platform 76. Besides reducing the overall weight of the mounting plate 70, this space allows better access to the arms 86, 86', 82, 82', for example, for convenient installation of the straps 60 and 56. To help maintain the preferred tightness of the retention strap, tensioning knobs 89 are provided at the back of the vertical support platform 76, near the top end of the platform 76 and protruding rearward out of the plane of the platform 76. These tensioning knobs 89 are preferred, as they act to provide the desired level of tension onto the retention strap to ensure that the device is tightly held against the front surface of the vertical support platform 76.

General Descriptions of Preferred Features of Certain Embodiments:

It has become commonplace that a higher percentage of citizens of nearly all ages own a modern day smartphone and carry it on their person on a day to day basis. Thus, the modern day smartphone has become the most common electronic device known to be carried by a high percentage of the population. Often a person may unexpectedly desire to record video while at an event, or at some point in their day to day activities while away from home. Thus, the modern day smartphone is the most convenient device that would be expected to be used for such video recording purposes. Specialty video recording devices do not often fit into a pocket or purse, and are not often carried on a day to day basis by a typical person. The preferred head-mount device effectively creates more convenience due to the fact that smartphones are being carried by such a high percentage of the population. Additionally, the device can be easily carried on one's person, in a coat pocket, purse, back pack or other means, due to the small lightweight nature of the design and associated materials. Additional convenience is created by the fact that the device will work with a high percentage of smartphone designs, thereby allowing the user to operate the device with their current smartphone model, or a different model that they may obtain in the future.

By their nature, camera devices (especially portable electronic devices with video functions) are meant to be utilized by an individual taking video of gatherings, events, celebrations, or day to day activities. A problem arises when an individual desires to take a record video from their own point of view in a particular setting, or during an event. This situation often occurs with portable devices, such as wireless or cellular telephones with video recording functions, where a user simply holds the device with one or two hands. Often, holding the device for a long period of time is challenging, especially with arms fully outstretched. Such traditional methods do not allow for a person to have both hands free to participate in an event, or to hold other items such as a beverage, or small child. In addition, transporting a specialty video recording device and the necessary accessories for such uses can be challenging, creating issues for convenience and storage of such apparatuses.

The inventor has created an effective way of mounting a smartphone or other video-capable electronic device on the user's head, for hand-free use.

The head strap assembly may be conveniently constructed from conventional materials by conventional sewing and/or adhesive techniques. Preferably, the head strap assembly, elastic retention strap, tri-glide mechanism, and hook/loop fasteners are of good quality to obtain the desired effect, all existing materials being readily available through traditional sourcing methods. The intention of the mounting plate design is to provide a customized mechanism to serve the intended purposed for the invention. This is a custom injection molded item for which a mold can be created, and thus the desired part can then be manufactured from the mold. The mounting plate may be of a different size compared to those shown in the drawings, for example, different strap arms/slots can be utilized to accommodate different sizes and thicknesses of straps. The materials and parts making up the head strap assembly and retention strap may be elastic webbing material, for example, or other materials such as leather, rubber, specialty elastics, grippy elastic, and/or specialty materials for specific devices or economy reasons. Also, the number of straps and/or slots/arms could be changed and/or the arm(s)/slot(s) could be placed differently in certain embodiments to accommodate specialty electronic devices. It may be said that the head strap assembly may include "at least one" strap, which may include "at least one" circumferential strap. While it is preferred that the full head strap assembly is provided as shown, some less-preferred embodiments may simply provide the circumferential side-strap, therefore only providing one strap, rather than an apparatus that also includes a top-strap.

Additionally, while the preferred retention strap contains patches of hook and loop fastener, an alternative design would be to utilized alternative fastening connections such as snaps, adhesives, or buckles.

The preferred mounting plate, retention strap, and head strap assembly described herein provides a unique attachment option while wearing the device in conjunction with an electronic device in landscape orientation, thus, allowing the wearer's hands to remain free while recording video. The device's ability to function with a broad spectrum of devices is accomplished in certain embodiments at least in part because the design features and specific dimensions and physical characteristics of the apparatus. There is some leeway in the overall length and width of the mounting plate; even with this leeway and variation, the apparatus will still be able to generally secure an electronic device to the apparatus and allow the wearer to record video while the electronic device is securely retained within the device. Preferably, the retention strap arms are located above the top-strap slot/arms to ensure that the head strap apparatus does not inadvertently limit the functionality of the retention strap. Also, adaptations may be made in certain embodiments in the level of forward tilt used for the support platform that is used to capture the desired field of view of the wearer. The vertical support platform could optionally be designed to allow for adjustability in said tilt, thereby resulting in a broader spectrum of field of view for the wearer. For example, the vertical support platform may be hingedly attached to the main body, with a locking/tightening mechanism. Thus, the nature of the vertical support platform may vary, as it would optionally be designed with a small hinge or other lockable pivot feature to allow a wider field of view.

From this description and the drawings, one may understand that the electronic device may be easily placed inside the loop opening between the mounting plate and retention strap and securely retained there to achieve landscape orientation for hands-free video recording. Thus, the device is a convenient and economical apparatus for securing an electronic device from a head-mount device for hands free video recording. It is especially beneficial for those taking video with a smartphone, or some other type of electronic device with video capabilities whereby the apparatus enhances the quality of the experience that the wearer has during the video recording process, or event at which they are recording video.

The device-capturing strap that extends from the mounting plate may be textiles, woven or braided material, polymeric or rubber materials, or other preferably flexible and elastic material, but, most preferably, they are materials having elasticity and the capacity to maintain their integrity through conventional sewing techniques. The preferred material would ideally contain strips of silicone material applied, adhered, or attached to one side of the strap to create a "grippy" effect between the device and the strap itself. The preferred materials are not permanently deformed from normal stretching, but return to their original shape once the stretching stress (tension) is removed. Typically, fabrics having these qualities are not translucent. Non-limiting examples of materials that can be used include synthetic rubbers such as neoprene (polychloroprene); petrochemical based or other synthetically manufactured fibrous materials such as spandex (elastane), nylon, olefin fiber, polyester fabric, rayon, and particularly combinations and blends of the noted materials with each other and with other animal, plant, mineral or synthetic based textile such as cotton. In one aspect, the flexible and elastic fabric material can include a blend including neoprene and spandex.

The mounting plate assembly is adapted to limit relative movement between the mounting plate and the electronic device when the retention strap is tightened. As used herein, the terms "tightened" and "tightly" refer to a fit including direct physical contact between at least a majority of surfaces sufficient to create a resistance to displacement due to the frictional forces caused by said direct physical contact of the surfaces. For proper use of the strap, the amount of friction maintaining placement of an electronic device in an associated strap is sufficient to reliably counteract gravity, but is preferably relatively easy to overcome by purposeful user manipulation (as with inserting and removing the electronics device).

As used herein, directional-based descriptive terms, such as "front," "back," "side," "top," "bottom," and the like are used for ease of discussion. Such use is not to be interpreted as requiring use only in such direction or orientation, but only that these directional descriptors help the writer to describe elements of the embodiments relative to each other, and to describe the elements relative to example (but not necessarily all) electronic devices As used herein, the terms portrait and landscape refer to the page orientation of the camera/device as being vertical or horizontal. Page orientation is the way in which a rectangular page, or photograph, is oriented for normal viewing, in this case referenced as a vertical orientation of a rectangular shaped device. The two most common types of orientation are portrait and landscape. The specific word definition comes from the fact that a close-up portrait of a person's face and upper body is more fitting for a canvas or photo where the height of the display area is greater than the width. Landscape originally described artistic outdoor scenes where a wide view area is needed, but the upper part of the photo would be mostly sky and so is omitted. In this case, landscape is referred to as a horizontal orientation of a rectangular shaped electronic device (long dimension of the device being horizontal).

The lower support platform may be described as extending generally horizontally from the main body of the mounting plate, and the vertical support platform may be described as extending generally vertically upward from the main body. Likewise, describing support platform 74 as "horizontal" or "generally horizontal", or support platform 76 as "vertical" or "generally vertical", are indicators of their general orientation when in use, but this should not necessarily be construed to limit them to these orientations or uses. The electronic device, when captured, may rest downward on the lower support platform and rearward against the vertical support platform. The vertical support platform is designed to be slightly tilted forward relative to vertical (about 17-25 degrees, for example, relative to vertical, see FIG. 5A), when the head mount apparatus is in use on the wearer's head; this slight forward tilt allows the camera lens to be directed in the general field of view for the common user. The preferred angle of tilt allows for the general field of view to be captured during the video recording process. The mounting plate itself can be shifted upwards or downwards on a person's forehead, which is generally angled from brow to hairline, to allow for minor changes in the desired field of view that is being captured during the video-taking process due to the angled nature of the typical forehead, thus providing some basic adjustability with regards to field of view.

In certain embodiments, the mounting plate comprises generally rectangular openings/slots to allow an elastic strap to be inserted and pulled through, and/or arms for receiving loops of the elastic strap. The vertical support platform is preferably wider than the elastic strap material, to allow the preferred strap to attach in the desired fashion. The retention strap is sized in length so that it may encircle the electronic device resting against the vertical support platform also resting upon the lower support platform, extend through a slot within the lower support platform, extend back up over the device, and fasten back upon itself at the proximal end by hook-and-loop fastening.

The elastic retention strap may be disconnected from itself and loosened to receive the electronic device through the opening between the mounting platform and the strap itself. Once retightened, the retention strap holds the electronic device so that the length of the device is horizontal to the longitudinal axis of the circumferential side-strap, that is, "held horizontally" in a landscape orientation with the electronic device secured to the central region of the mounting plate. Therefore, the preferred mounting plate and retention strap thus is adapted to hold the electronic device horizontally with its lens exposed, with the desired viewing angle established by the upright support (vertical support platform).

In use, after the record button of the electronic device is pushed to initiate recording, the electronic device is inserted into the opening between the mounting plate and retention strap (leaving the camera lens exposed), and the retention strap is then sufficiently tightened around the device and fastened. The user can then slip the connected head strap assembly onto his/her head to allow for hands free video recording. Alternatively, the electronic device can be inserted into the loop opening and mounting platform, secured in place, and then the record button on the screen can be activated due to the fact that the button is typically displayed on the lower portion of the screen of the device, and is not covered by the mounting plate nor the retention strap. This device may be extremely useful for spectators who want video recordings of speaking events, sporting events, concerts, or day to day activities. This may be extremely useful for people who want video of activities, but want to keep their hands free, rather than continuously holding their device while recording video.

The specialty mounting plate is preferably firm, for example, rigid, so that the various features of the main body do not bend, droop, or twist. The preferred elastic strap material is somewhat flexible and soft, allowing for some comfort on the person's head. The firm exterior of the specialty mounting plate keeps electronic device pointing in the desired and predictable direction for proper pointing at the subject of the video, rather than twisting out of the desired field of view, or plane. Due to the rigidity of the mounting plate, it is preferred that an adhesive backed foam pad that is rectangular in shape is adhered to the back of the mounting plate where the part comes in contact with the forehead of a person wearing the device. The device will function properly without such a pad, but the intention is to increase the comfort of the device while being worn. The general thickness of the pad would preferably be at least ⅛" thick, and could potentially be thicker if so desired.

The main body of the mounting plate may be described as having multiple features extending outwards from the central region of the part. From this central region extends upward an elongated vertical support platform which serves as a location for the electronic device to rest against; a support platform extends outward at the front of the main body; two side-strap slots extends to each side of the main body; with a third central strap slot located at the upper portion of the main body of the mount identified as the top-strap slot. The upper vertical support platform preferably contains an additional strap attachment feature with two retention strap platforms to accommodate the elastic retention strap which loops around the device in a holstering fashion. The preferred height of the vertical support platform is a distance that is equal to or less than the width of the smallest electronic device that may be used with the device. If the length of the vertical support platform is too high, the retention strap will not sufficiently provide a downward force onto the top of the device, but only over the front face of the device itself, which may result in less than preferred tightness of the resulting hold between the strap and the device being secure to the mounting plate. The lower support platform extends outward from the front of the mounting plate, which contains two upward protruding triangular knobs. The knobs are intended to provide an opening below the device while it is inserted into the mount so as to minimize any interaction with the operational buttons that may exist on the side of the electronic device. The combination of the lower support platform and the upward protruding knobs design are unique features of the apparatus, because, when combined, they allow for a variety of different styles of devices to be tightly held within the mount, but minimizing any interaction between operational buttons on the electronic device and the support platform.

All the straps (52, 56, 60) are preferably flexible or at least bendable, so that they may effectively curve/wrap around the electronic device, fold/bend upon themselves, and/or around portions of the mounting plate, and/or curve/wrap/fold/bend as needed for fitting the wearer's head. Some inflexibility along short lengths may be acceptable, for example, as hook-and-loop patches can reduce flexibility in their regions. A "grippy" strap could optionally be used for the head strap apparatus as well, thereby providing some additional grip between the strap and the person's head to ensure the device does not easily fall off of, or from the wearer's head.

The preferred slot/arm-systems are shown for connection of loop-ends of straps to the mounting plate, as these systems are effective and not bulky or cumbersome. These systems also provide secure connection of the straps to the mounting plate, while still allowing the straps to be removed and replaced as desired. However, in certain embodiments, other fasteners/connectors may be used for connection of the straps to the mounting plate, for example, buckles, snaps, ties, or various quick-connect and quick-disconnect fasteners.

Hook-and-loop fasteners are the preferred quick-connect/disconnect fasteners for "securing" or "latching" the retention strap in its tightened configuration. Patches 92, 98 that are about 1.5" inches wide and 1.5"-2" long are secured to the same side of the strap, preferably the bare side which does not contain any silicone material. The hook-and-loop fastener may be sewn into place or adhesively-attached, for example.

The preferred materials described herein are available through conventional commerce. The elastic strap materials described can be purchased at craft stores, material outlets, quilting stores, and directly from manufacturers. In addition, there are a variety of manufacturers and dealers of such materials online, which allows for bulk purchasing of such materials. The strap hardware is available through a number of wholesale and retail outlets, such as outdoor wilderness fabrics which sells a variety of such hardware mechanisms described.

Certain embodiments may be described as a head mount apparatus for an electronic device with video recording capability, the head mount apparatus comprising, consisting essentially of, or consisting of: a mounting plate having an generally vertical platform and a generally horizontal platform; a retention strap having one end connected to a rear surface of the mounting plate and a fastener at an opposing end, the retention strap extending forward over the mounting plate and down to the generally horizontal platform forming a space between the retention strap and the front surface of the generally vertical platform for receiving the electronic device, wherein the retention strap is fastened in a tightened configuration over the electronic device to hold the electronic device against the mounting plate; and a head strap assembly comprising a generally circular side-strap for extending around a wearer's head, and a top-strap for extending over the wearer's head, the side-strap and the top strap being connected to the mounting plate so that the mounting plate is held on the wearer's forehead. The retention strap may further extend through a slot in the generally horizontal platform and extend upward and rearward to fasten said fastener to a portion of the retention strap located above the mounting plate, so that the retention strap fastens to itself after looping through said slot. The retention strap may be a single generally-vertically-extending strap and the only strap/member that holds the electronic device in the cradle of the mounting plate. The side-strap may have two ends, each connected to the mounting plate, so that the mounting plate is centered between said two ends for being centered on the wearer's forehead. The top-strap may be connected to and may extend between the mounting plate and a rear portion of the side-strap. The side-strap ends may comprise a right loop and a left loop, and the mounting plate may comprise right and left arms removably received in the right loop and left loop, respectively. The top-strap may comprise a front end loop and a rear end loop, wherein the mounting plate may comprise a set of top-strap arms extending from a rear side of the mounting plate and removably received in the front end loop. A rear portion of the side-strap may extend through the rear end loop to connect the top-strap to the side-strap. The head strap assembly may consist only of, or consist essentially of, the top-strap, the side-strap, and associated length adjustment devices, to create a simple, comfortable, and easy-to-use head unit. For example, the head strap assembly or head unit of certain embodiments will not include a cap, cover, helmet, or hat, but, instead, will be substantially or entirely straps. [0081] The generally vertical platform and the generally horizontal platform may be portions of a generally-L-shaped member, extending from a main body of the mounting plate/L-shaped member at an angle from each other that is in the range of 18-28 degrees, or about 18-28 degrees, for example. The retention strap is preferably elastic and comprises grip-material on a side that faces the electronic device for betting gripping and capturing of the electronic device even in the event the wearer moves quickly or drastically. The side-strap is preferably elastic and comprises a length-adjustment mechanism for tightening the side-strap on a wearer's head.

Certain embodiments may be described as a head mount system for hand-free video recording, the system comprising, consisting essentially of, or consisting of: an electronic device with video recording capability; and a head mount apparatus comprising, consisting essentially of, or consisting of: a generally-L-shaped mounting plate having a generally vertical platform and a generally horizontal platform forming between them a cradle receiving the electronic device so that a rear surface of the electronic device is against the generally vertical platform; a retention strap having a proximal end connected to a rear surface of the mounting plate and a fastener at an opposing distal end, the retention strap extending forward over the electronic device and down to the generally horizontal platform, the retention strap looping through a slot in the generally horizontal platform and extending upwards, wherein the retention strap distal end is fastened to the proximal end with the retention strap in a tightened configuration against the electronic device. The generally horizontal platform may comprise upward protrusions that hold a lower surface of the electronic device to prevent electronic device functional buttons on said lower surface from contacting the retention strap and the mounting plate. For example, the generally horizontal platform may comprise a downwardly-slanted top surface portion and a portion of the retention strap extends along said downwardly-slanted top surface portion, a corner edge of the electronic device resting on said portion of the retention strap so that functional buttons on a lower surface of the electronic device are in a empty space beside the downwardly-slanted top surface and do not contact the mounting plate of the retention strap. The system may further comprise a head strap assembly comprising a generally circular side-strap for extending around a wearer's head. The head strap assembly may further comprise a top-strap for extending over the wearer's head, the side-strap and the top strap being connected to the mounting plate so that the mounting plate is held on the wearer's forehead. The side-strap may have right and left loops at ends of the side-strap, and the top-strap may have a front end loop, the right and left loops being connected to arms at the right and left sides of the mounting plate, and the front end loop being connected to rear arms of the mounting plate. Said arms at said right and left sides may each be a set of two arms reaching near to each other with a gap between the two arms for insertion of the right and left loops between and over the two arms. Said rear arms may comprise two arms reaching near to each other with a gap between the two arms for insertion of the front end loop between and over the two arms. The retention strap distal end may extend along and attach by hook and loop patches to the proximal end of the retention strap at a location over and rearward of the electronic device. The mounting plate may comprise rearward protrusions at an upper end of the generally vertical platform, and wherein the retention strap proximal end and distal end both extend across the rearward protrusions at or near said hook and loop patches. A cushion pad may be provided on a rear side of the mounting plate for resting against a wearer's head.

Certain other embodiments may be described as a head mounting device for an electronic device having video capability, the mount comprising: a specialty mounting plate mechanism comprising multiple strap slots, strap arms, vertical support platform and lower support platform; a head strap apparatus comprising a top-strap and circumferential side-strap, each including a tri-glide mechanism to provide adjustability while straps are connected to the mounting plate; a retention strap extending from the upper region of the support platform, connected via strap arms; and a retention strap connected to an upper portion of vertical support platform of the mounting plate and, extendible to wrap around the lower support platform to form a retention loop defining a space between the strap and a front side of the head mount plate, the space being for receiving the electronic device in a landscape orientation; a support platform which includes two upward protruding knobs, creating a space between the support platform and the electronic device for receiving the operational buttons; and a vertical support platform the extends generally upward from the main body of the mounting plate, whereby the angular orientation of the support platform relative to said main body is slightly forward, allowing the desired field of view to be captured. The longitudinal portion (circumferential portion) of the head strap assembly may extend from slots on each side of the mounting plate, and a second strap may extend from the central region of the mount to connect with said top-strap. The retention strap loop may attach at a slot at the upper region of the mounting plate's vertical support platform. A top-strap with loop sewn in place at one end and a tri-glide mechanism sewn at the other may be provided, allowing the loop end to be inserted through the tri-glide to create a second loop, both said loops thereby acting as connecting locations with the head mount plate. A second strap may be provided, oriented transverse to the first strap with loop sewn in place at one end and a tri-glide mechanism sewn at the other, allowing the loop end to be inserted through the tri-glide to create a second loop, the first loop acting as a connecting location with the head mount plate while the second loop acts as a connecting feature with the first strap. A side-strap may be provided with loop and patch of loop fastener sewn in place at one end and a patch of hook fastener sewn at the other, with said loop thereby acting as connecting location with the head mount plate. The retention strap is preferably elastic and comprises silicone material adhered to one side of said strap. An upper vertical support platform may extend upward from the central region (of the mounting plate), and a lower support platform may extend forward from the lower portion (of the mounting plate) and have upward protruding triangular knobs for protection of buttons of the electronic device from being compressed by capture of the device. The upward protruding knobs may be specific in shape and location to inhibit connection/contact between the mounting plate and the operational buttons that may exist along the side of an electronic device. The lower support platform may comprise an open slot being for receiving the distal end of the retention strap thereby creating a cradle/opening between the mount and the strap serving as a location to securely hold an electronic device. The upper vertical support platform may extend upward from the central region in such a way that the angular orientation of the support platform relative to said main body is slightly forward, allowing the desired field of view to be captured. The electronic device preferably has a lens near one end for video recording, wherein the lens is not covered/obstructed by any part of the head mount device, specially not covered/obstructed by the mounting plate or the retention strap.

Certain embodiments may be methods of using any of the apparatus disclosed herein. For example, embodiments may be a method of securing an electronic device to a head-mount apparatus for hands-free video, the method comprising: providing a head-mount apparatus including a head strap assembly, retention strap, and head mount; detaching the distal end patch of fastener from the proximal end patch of fastener to allow the device loop opening to be created between the retention strap and vertical support platform; loosening the retention strap to create an opening, and placing an electronic device horizontally into the opening between the strap and the mount, whereby the device is held in the proper orientation/direction to capture the desired field of view; tightening the retention strap to retain the device securely therein; and pulling the head strap apparatus onto a person's head to be worn during video recording.

Although this invention has been described above with reference to particular means, materials and embodiments, it is to be understood that the invention is not limited to these disclosed particulars, but extends instead to all equivalents within the broad scope of the following claims.

What is claimed is:

1. A head mount apparatus for an electronic device with video recording capability, the head mount apparatus comprising:

a mounting plate having a generally vertical platform and a generally horizontal platform;

a retention strap haying one end connected to a rear surface of the mounting plate and a fastener at an opposing end, the retention strap extending forward over the mounting plate and down to the generally horizontal platform forming a space between the retention strap and the front surface of the generally vertical platform for receiving the electronic device, wherein the retention strap is for being fastened in a tightened configuration over the electronic device to hold the electronic device against the mounting plate;

a head strap assembly comprising a generally circular side-strap for extending around a wearer's head, and a top-strap for extending over the wearer's head, the side-strap and the top strap being connected to the mounting plate so that the mounting plate is held on the wearer's forehead;

wherein the top-strap is connected to and extends between the mounting plate and a rear portion of the side-strap;

wherein the top-strap comprises a front end loop and a rear end loop, wherein the mounting plate comprises a set of top-strap arms extending from a rear side of the mounting plate and removably received in the front end loop, and wherein a rear portion of the side-strap extends through the rear end loop to connect the top-strap to the side-strap.

2. The head mount apparatus as in claim 1, wherein the retention strap further extends through a slot in the generally horizontal platform and extends upward and rearward to fasten said fastener to a portion of the retention strap located above the mounting plate, so that the retention strap fastens to itself after looping through said slot.

3. The head mount apparatus as in claim 1, wherein the side-strap has two ends each connected to the mounting plate, so that the mounting plate is centered between said two ends.

4. The head mount apparatus as in claim 3, wherein the side-strap ends comprise a right loop and a left loop, and the mounting plate comprises right and left arms removably received in the right loop and left loop, respectively.

5. The head mount apparatus as in claim 1, wherein the generally vertical platform and the generally horizontal platform extend from a main body of the mounting plate at an angle from each other that is in the range of 18-28 degrees.

6. The head mount apparatus as in claim 1, wherein the retention strap is elastic and comprises grip-material on a side that faces the electronic device.

7. The head mount apparatus as in claim 1, wherein the side-strap is elastic and comprises a length-adjustment mechanism for tightening the side-strap on a wearer's head.

8. A head mount system For hand-free video recording, the system comprising:

an electronic device with video recording capability; and a head mount apparatus comprising:

a generally-L-shaped mounting plate having a generally vertical platform and a generally horizontal platform forming between them a cradle receiving the electronic device so that a rear surface of the electronic device is against the generally vertical platform;

a retention strap having a proximal end connected to a rear surface of the mounting plate and a fastener at an opposing distal end, the retention strap extending forward over the electronic device and down to the generally horizontal platform, the retention strap looping through a slot in the generally horizontal platform and extending upwards, wherein the retention strap distal end is fastened to the proximal end with the retention strap in a tightened configuration against the electronic device; and the system further comprising a head strap assembly comprising a generally circular side-strap for extending around a wearer's head and a top-strap for extending over the wearer's head, the side-strap and the top strap being connected to the mounting plate so that the mounting plate is held on the wearer's forehead;

wherein the side-strap has right and left loops at ends of the side-strap, and the top-strap has a front end loop, the right and left loops being connected to arms at the right and left sides of the mounting plate, and the front end loop being connected to rear arms of the mounting plate.

9. The system as in claim 8, wherein the electronic device comprises a lower surface having functional buttons and the generally horizontal platform comprises upward protrusions that hold the lower surface of the electronic device to prevent the electronic device functional buttons on said lower surface from contacting the retention strap and the mounting plate.

10. The system as in claim 8, wherein the generally horizontal platform comprises a downwardly-slanted top surface portion and a portion of the retention strap extends along said downwardly-slanted top surface portion, a corner edge of the electronic device resting on said portion of the retention strap so that functional buttons on a lower surface of the electronic device are in a empty space beside the downwardly-slanted top surface and do not contact the mounting plate or the retention strap.

11. The system as in claim 8, wherein said arms at said right and left sides are each a set of two arms reaching near to each other with a gap between the two arms for insertion of the right and left loops between and over the two arms.

12. The system as in claim 8, wherein the rear arms comprise two arms reaching near to each other with a gap between the two arms for insertion of the front end loop between and over the two arms.

13. A mounting system for hand-free video recording, the system comprising:

an electronic device with video recording capability; and a mounting apparatus comprising:

a generally-L-shaped mounting plate having a generally vertical platform and a generally horizontal platform forming between them a cradle receiving the electronic device so that a rear surface of the electronic device is against the generally vertical platform;

a retention strap having a proximal end connected to a rear surface of the mounting plate and a fastener at an opposing distal end, the retention strap extending forward over the electronic device and down to the generally horizontal platform, the retention strap looping through a slot in the generally horizontal platform and extending upwards, wherein the retention strap distal end is fastened to the proximal end with the retention strap in a tightened configuration against the electronic device, and the retention strap distal end extends along and attaches by hook and loop patches to the proximal end of the retention strap at a location over and rearward of the electronic device;

wherein the mounting plate comprises rearward protrusions at an upper end of the generally vertical platform, and wherein the retention strap proximal end and distal end both extend across the rearward protrusions at or near said hook and loop patches.

14. The system as in claim 8, comprising a cushion pad on a rear side of the mounting plate for resting against a wearer's head.

* * * * *